US008453280B2

(12) United States Patent
Martray

(10) Patent No.: US 8,453,280 B2
(45) Date of Patent: Jun. 4, 2013

(54) QUILT-STYLE SLEEPING BAG WITH ASSOCIATED SLEEPING PAD ATTACHMENT SYSTEM AND METHOD OF USE THEREOF

(76) Inventor: Aaron Martray, Wheat Ridge, CO (US)

( * ) Notice: Subject to any disclaimer, the term of this patent is extended or adjusted under 35 U.S.C. 154(b) by 536 days.

(21) Appl. No.: 12/689,203

(22) Filed: Jan. 18, 2010

(65) Prior Publication Data

US 2011/0173749 A1 Jul. 21, 2011

(51) Int. Cl.

| | |
|---|---|
| ***A41B 13/06*** | (2006.01) |
| ***A47G 9/02*** | (2006.01) |
| ***A47G 9/08*** | (2006.01) |

(52) U.S. Cl.

USPC ..... 5/413 R; 5/413 AM; 5/420; 5/417; 5/494; 5/496; 5/498

(58) Field of Classification Search

USPC ..... 5/413 R, 413 AM, 420, 417, 494, 5/496, 498, 691, 722, 723, 628; 24/129 R, 24/130, 129 B, 582.1, 592.1, 582.11, 592.11, 24/598.5, 598.8, 600.2, 372

See application file for complete search history.

(56) References Cited

U.S. PATENT DOCUMENTS

| | | | | | |
|---|---|---|---|---|---|
| 829,320 | A | * | 8/1906 | Clark | 24/129 B |
| 3,750,202 | A | | 8/1973 | Merikallio | |
| 3,831,206 | A | | 8/1974 | Geary | |
| 4,163,372 | A | * | 8/1979 | Frye et al. | 62/259.1 |
| 4,605,029 | A | | 8/1986 | Russell | |
| 4,646,394 | A | * | 3/1987 | Krauss | 24/129 R |
| D289,373 | S | * | 4/1987 | Kimball | D8/382 |
| 4,660,240 | A | * | 4/1987 | Hutton et al. | 5/669 |
| 4,884,303 | A | | 12/1989 | Scherer | |
| 4,888,828 | A | | 12/1989 | Tatsuno | |
| 5,193,235 | A | | 3/1993 | Kircher | |
| 5,533,216 | A | * | 7/1996 | Thier | 5/413 R |
| 5,735,003 | A | | 4/1998 | Judge | |
| 5,815,833 | A | * | 10/1998 | Kuo | 2/69.5 |
| 5,815,861 | A | * | 10/1998 | LaGrange et al. | 5/504.1 |
| 5,887,299 | A | | 3/1999 | Phillips | |
| 5,966,756 | A | | 10/1999 | Cartier | |
| 6,018,830 | A | | 2/2000 | Howe | |
| 6,163,907 | A | * | 12/2000 | Larson | 5/691 |
| 6,345,873 | B1 | * | 2/2002 | Kim | 312/209 |
| 6,438,774 | B1 | * | 8/2002 | Michaelis et al. | 5/413 R |
| 7,051,387 | B1 | | 5/2006 | Yoder et al. | |
| 7,171,707 | B2 | * | 2/2007 | Landay | 5/413 R |
| 7,213,278 | B2 | * | 5/2007 | Peterson et al. | 5/413 R |
| 2003/0219566 | A1 | * | 11/2003 | Berkowitz et al. | 428/100 |
| 2006/0162072 | A1 | | 7/2006 | Tenenbaum et al. | |
| 2007/0000053 | A1 | * | 1/2007 | Yang | 5/493 |

(Continued)

*Primary Examiner* — Robert G Santos
*Assistant Examiner* — David E Sosnowski
(74) *Attorney, Agent, or Firm* — Leyendecker & Lemire, LLC; Kurt Leyendecker

(57) ABSTRACT

A quilt-style sleeping bag including clip, buckles, snaps, hook and loop material, buttons or any other suitable attachment means secured with the bag proximate the left and right longitudinal edges of the bag that are adapted to cooperatively couple with a cord, strap, string, rope or cable (hereafter collectively referred to as "cords") that extends widthwise across a sleeping pad is described. The clips in conjunction with the complimentary cords permit a user to secure the left and right edges of the bag to the top side of the sleeping pad and furthermore, hold the edges of the bag against the top side of the sleeping pad. Accordingly, the ability of the edges to lift up and permit cold air to enter the interior volume of the bag and the pad combination is minimized, despite normal movements of a user during sleep.

20 Claims, 10 Drawing Sheets

U.S. PATENT DOCUMENTS

2007/0136946 A1* 6/2007 Haislip ..... 5/413 R
2008/0184533 A1* 8/2008 Kelly ..... 24/129 R
2008/0216238 A1* 9/2008 Tatsuno ..... 5/420
2009/0000086 A1* 1/2009 Bing ..... 24/592.11
2009/0035499 A1 2/2009 Wandel
2011/0113550 A1* 5/2011 Lafoux ..... 5/413 R

* cited by examiner

QUILT-STYLE SLEEPING BAG WITH ASSOCIATED SLEEPING PAD ATTACHMENT SYSTEM AND METHOD OF USE THEREOF

FIELD OF THE INVENTION

The present invention relates to sleeping bags and mechanisms and methods for attaching sleeping bags to sleeping pads.

BACKGROUND

A traditional sleeping bag typically comprises an elongated bag comprised of an insulated blanket. It has an open top end and a closed bottom end and often includes a zipper or other closure means extending along at least one elongated edge thereof for opening and closing the bag. A user typically positions himself in the bag between top and bottom sides while the zipper is at least partially unfastened and then closes the bag to substantially encapsulate his body within the bag with his head often extending out of the open top end.

Sleeping bags are typically used by campers and backpackers to provide warmth when sleeping outside. Sleeping bags are often assigned temperature ratings which indicate the outside temperature at which a user can sleep in bag either comfortably or without undue risk of hypothermia. As can be appreciated, the temperature rating of a particular bag is directly affected by the amount of insulation or "fill" provide in the insulated blanket that comprises the sleeping bag. Simply, more fill allows the bag to be used at lower temperature while less fill results in a bag that permits a more comfortable sleep at higher outside temperatures. Traditional fill materials include down and synthetic batting. The loft or thickness of the fill material creates pockets of dead air that hinder the transfer of heat from the user's body thereby keeping him/her warm.

When a user lies in the bag, the fill underneath him and in contact with the underlying surface compresses, eliminating many of the air pockets and thereby reducing the insulating capacity of the bag in that region. Accordingly, campers and backpackers that are going to be sleeping on an uninsulated surface such as the ground typically utilize a sleeping pad. Sleeping pads typically comprise a firm flexible foam material that does not compress completely when laid upon, thereby sufficiently insulating a user from the cold ground.

Considering the foregoing, it can be appreciated that the primary function of the compressed portions of the sleeping bag located between a sleeping user and an underlying surface is not to insulate the user. Rather, this compressed portion of the bags acts primarily to ensure continuity of the tubular portion of the bag, thereby preventing the easy escape of warm air within the bag or the infiltration of cold external air into the bag.

Within the last ten years or so, several companies have begun to sell backpacking quilts (also referred to herein as "quilt-style sleeping bags") that eliminate most of the bottom portion of the bag that provides little insulating value. Backpacking quilts typically differ from traditional quilted blankets in that an enclosed or closable foot box is usually provided at a bottom end to ensure maximum insulation of the feet as well as minimize the intrusion of cold drafts of air. A user places his feet in the foot box and simply drapes the remainder of the quilt style bag over himself with the respective left and right edges extending over left and right edges of a corresponding sleeping pad not unlike the way in which a typical blanket is used when sleeping in a bed.

The advantages of a quilt-style sleeping bag over a traditional sleeping bag are several. First and perhaps the most important advantage to backpackers is that the weight of the bag is reduced, thereby lightening the load a backpacker will have to carry. Another advantage is that because quilt-style bags do not have zippers and typically use less material than traditional bags, they compress more than traditional bags, thereby taking up less volume in a user's pack. Further, since there is no zipper, zipper failure is not a concern.

There are, however, several disadvantages of using a quilt-style sleeping bag over a traditional sleeping bag. First for users who toss and turn or otherwise move significant amounts during sleep, there is a risk that they will push their bags off of their bodies exposing their bodies to cold air but also allowing any warmed air in the interior volume formed collectively by the bag and the sleeping pad to escape. Second and perhaps more significantly, there is a high likelihood that for even users that do not move too much during sleep, cold air will seep into the interior volume formed collectively by the bag and the sleeping pad as the left and right edges of the bag are occasionally raised above the edges of the associated sleeping pad when a user moves around even minimally during sleep.

Manufacturers of quilt-style bags have offered several solutions to resolve one or both of the disadvantages provided above. At least one manufacturer has provided one or more sets of straps 105 that extend from the left longitudinal edge 110 of the bag 100 to the right longitudinal edge 115 of the bag. In use, the straps are placed underneath the body of a user 120 as shown in Prior Art FIG. 1. While this solution does ameliorate some of the problems caused by the first disadvantage, the user's back (assuming the user sleeps on his/her back) will be exposed to cold air if he/she changes position during sleep.

Another solution offered by at least one manufacturer is to provide longer sets of straps 125 that are similarly attached to left and right edges 110 & 115 of the bag 100 such that the straps can be looped under a sleeping pad 130 as shown in Prior Art FIG. 2. Of particular note, the edges of the bag are drawn either up against the edge of the pad or underneath the pad. This solution solves the problems associated with the indicated disadvantages but introduces another problem. Namely, it creates a large interior volume 135 of air that must be warmed by the user's body heat. Large interior volumes of air space lower the effective temperature rating of a bag relative to a similar bag having the same amount of fill but a lower volume. Accordingly, to achieve a given temperature rating even more fill must be utilized raising the weight of the bag and the cost to produce it.

DETAILED DESCRIPTION

Figure 1:
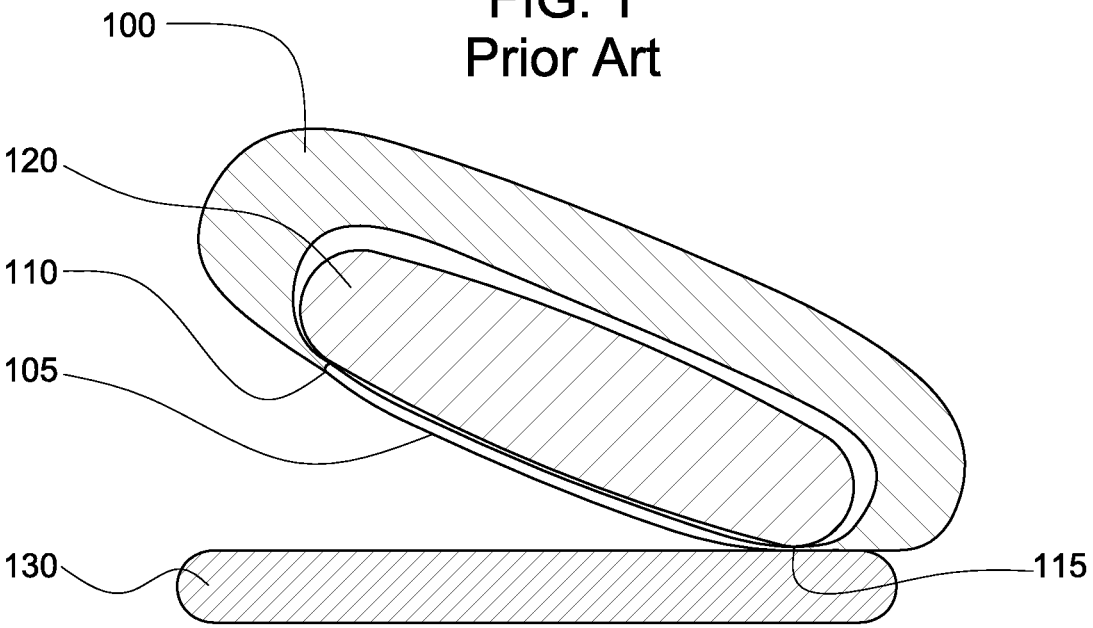
FIG. 1 Prior Art
FIG. 1 is a stylized cross-sectional view of a user lying on a sleeping pad and covered by a prior art quilt-style sleeping bag wherein the bag includes straps that are passed underneath the user's body.
Figure 2:
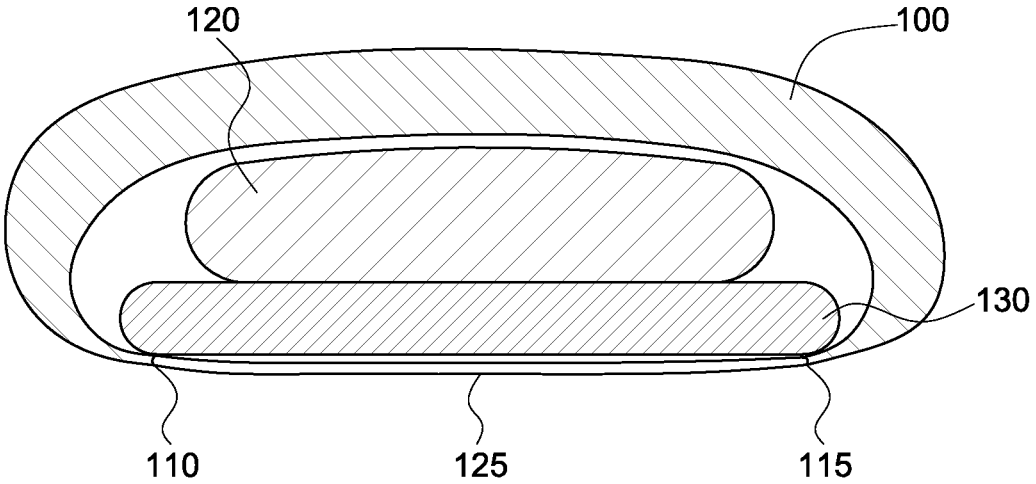
FIG. 2 Prior Art
FIG. 2 is a stylized cross-sectional view of a user lying on a sleeping pad and covered by another prior art quilt-style sleeping bag wherein the bag includes straps that are passed underneath the sleeping pad.

Embodiments of the present invention comprise a quilt-style sleeping bag that includes clip, buckles, snaps, hook and loop material, buttons or any other suitable attachment means secured with the bag proximate the left and right longitudinal edges of the bag that are adapted to cooperatively couple with a cord, strap, string, rope or cable (hereafter collectively referred to as "cords") that extends widthwise across a sleeping pad. The clips in conjunction with the complimentary cords permit a user to secure the left and right edges of the bag to the top side of the sleeping pad and furthermore hold the edges of the bag against the top side. Accordingly, the ability of the edges to lift up and permit cold air to enter the interior volume of the bag and the pad combination is minimized despite normal movements of a user during sleep.

In some embodiments, the cords are formed into loops that tautly encircle any suitable sleeping pad at locations that correspond to the clip locations on the sleeping bag when properly positioned on the pad. The cords are typically formed into a loop by fastening its end portions together, such as by tying, permitting the use of the bag in conjunction with almost any sleeping pad. As such, the user is not limited to using a pad designed specifically for use with the bag. However, other embodiments are contemplated wherein the cords are directly attached to specifically designed pads, i.e. the ends of a cord are sewn or otherwise secured to the pad at specific points along the left and right edges thereof. In these variations, the cords need not encircle the pad but rather extend widthwise over one side of the pad.

At least one embodiment utilizes primary and secondary sets of clips. The primary clips are located substantially at the bag's left and right longitudinal edges and in some variations include two cord attachment positions: one in which the clip can move freely along the cord and one in which the position of the clip on the cord is essentially fixed. These clips, which are provided in sets of two at corresponding opposing positions on the left and right edges, act to hold the left and right edges in direct contact with the top surface of the pad. Typically, at least two sets of primary clips are provided at locations distributed along the respective left and right edges. The positions of the clips or other attachment means are adjustable along the corresponding cords in a widthwise or lateral direction over the pad. This permits the user to better envelope the bag around him or her and minimizes the interior volume and consequently the amount of air that must be warmed by body heat to maintain the user at a comfortable temperature.

The sets of secondary clips are typically located at similar longitudinal positions as a corresponding set of primary clips but are spaced laterally outwardly of the primary clips and the longitudinal edges of the bag. The secondary clips work in conjunction with the primary set of clips to hold the portions of the bag laterally between the left and right edges and the lateral location of the secondary clips in contact with the top surface of the pad. As the distance between the edges and the corresponding clips is typically a few inches to ten inches or so, the increased area of contact with the top surface of the pad further inhibits the intrusion of cold air into the interior volume.

Advantageously, embodiments of the present invention provide the weight savings of a quilt-style sleeping bag but maximize its suitability for use in lower temperatures by: (i) creating an interior volume when used in combination with a sleeping pad that is not as susceptible to breach when a user rolls over or otherwise moves normally during sleep; and (ii) minimizing the excess volume of air contained within the interior volume that must be heated by the user during sleep.

Terminology

The terms and phrases as indicated in quotes (" ") in this section are intended to have the meaning ascribed to them in this Terminology section applied to them throughout this document, including the claims, unless clearly indicated otherwise in context. Further, as applicable, the stated definitions are to apply, regardless of the word's or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. Concerning angular measurements, "about" or "generally" refers to +−10 degrees and "substantially" refers to +−5.0 degrees unless otherwise indicated. It is to be appreciated that not all uses of the above terms are quantifiable such that the referenced ranges can be applied.

The phrases "quilt-style sleeping bag", "quilt-style bag" and "backpacking quilt" all refer to an insulated blanket that is typically, but not necessarily shaped at the bottom to form an enclosed end or "foot box". Above the "foot box", however, the bag is defined by opposing left and right "longitudinal edges". Unlike a traditional sleeping bag wherein a zipper is provided along its longitudinal edges to join the edges together and form a tubular bag, the left and right longitudinal edges of a quilt-style bag are not normally joined or coupled together along their lengths. In other words, from the "foot box" up, quilt-style bags are more akin to blankets than sleeping bags.

The term "cord" as used herein refers to any flexible, generally slender, elongated member along which a "clip" can be secured and/or slid there along. For this document a cord can be a strap, a string, a rope, a belt, a chain or a cable. A "cord loop" comprises a "cord" that has been joined permanently or removably to form a loop.

The term "clip" as used herein refers to any connector that can be attached to a "cord" either securing it at a specific place on the cord or permitting it to slide along the length of the cord. For this document a clip can be, but is not limited to, a clamp, a clasp, a buckle, a cord lock, a hook, and hook and loop material straps. In this document, two types of clips are identified: primary and secondary. As used herein, a "primary clip" is one that is located at or closely proximate one of the left and right longitudinal edges. For instance, the primary clips are most typically secured at the edge when the top and bottom fabric layers that sandwich the fill are seamed together: the clip is simply placed in the path of the sewing machine. As used herein, a "secondary clip" is one located laterally inline with a primary clip but spaced at least a few inches from the corresponding longitudinal edge. In some embodiments, the secondary clip is provided to help ensure a better seal between the pad and the edges of the bag as might be useful when the outdoor temperature is particularly low.

The term "fill" as used herein refers to any suitable type of insulation that is utilized in the quilt-style bag. Traditionally, goose down fill has been used to insulate sleeping bags but many different synthetic fills are known as well.

The phrase "sleeping pad" as used herein refers to a cushioning pad that is laid upon a ground surface for a person to lie upon during use. A sleeping pad is most often used in combination with a sleeping bag and often provides insulating characteristics. "Sleeping pads" are often comprised of open or closed cell foams and/or a series of air baffles/pockets.

A Quilt-Style Sleeping Bag

Figure 3:
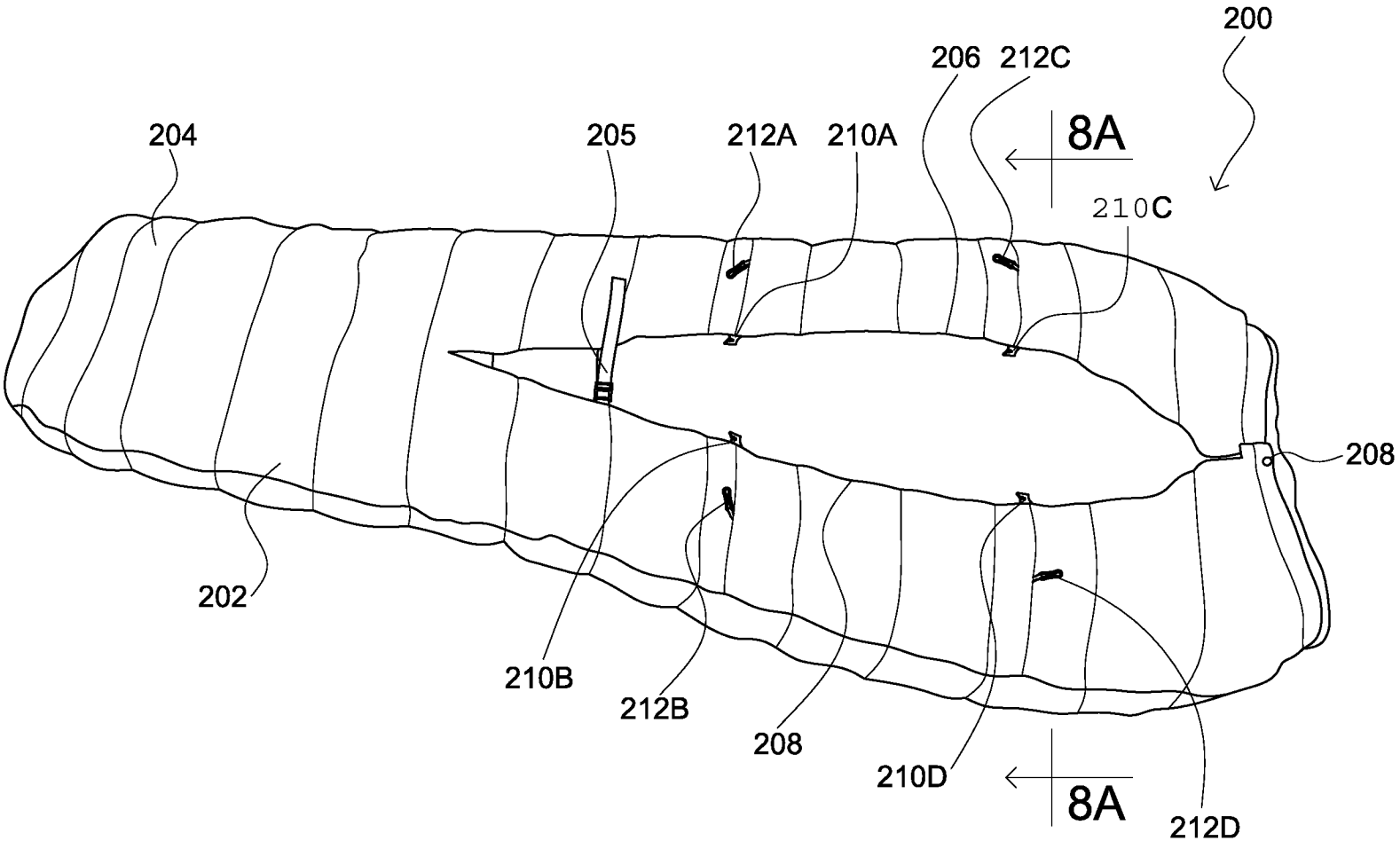
FIG. 3 is an isometric bottom view of a quilt-style sleeping bag incorporating primary and secondary cord clips attached thereto according to embodiments of the present invention.

FIG. 3 is a bottom side illustration of a quilt-style sleeping bag 200 according to one embodiment.

The bag essentially comprises an insulated blanket 202 that has been sewn at one end to form a foot box 204. It is to be appreciated that in variations the foot box can be formed from the blanket by other means including hook and loop material, lacing, and straps. Above the foot box, the left and right longitudinal edges 206 & 208 diverge forming a space there between that does not envelope a user while he or she is sleeping in the bag. Rather, the space overlies a sleeping pad 216 (see FIG. 8A for example) that acts to insulate the user from an underlying ground surface.

The insulated blanket 202 typically comprises top and bottom sheets of thin lightweight breathable fabric, such as but not limited to nylon or polyester ripstop fabric. Insulating fill is located between the fabric sheets. Goose down is a common high-performance insulating fill, although there are many synthetics available as would be known to those of ordinary skill in the art. At least concerning down, laterally extending baffles are typically provided in the blanket to maintain the relative longitudinal positions of the down. Without the baffles, the down would have a tendency to settle at one end of the bag and therefore provide uneven insulating capabilities.

About 4-12" above where the bottom ends of the left and right longitudinal edges intersect at the foot box 204, a strap and buckle assembly 205 is provided with ends thereof secured to the left and right longitudinal edges. The assembly prevents the edges from separating more than a predetermined amount during use. The length of the assembly is adjustable such that the predetermined amount can be adjusted. Furthermore, the buckle typically is releasable for those circumstances where the user does not want to constrict the spacing between the left and right edges at this longitudinal location.

At the top end of the bag, a connector assembly 208 is provided to permit a user to selectively secure the longitudinal edges of the bag together proximate the user's neck and head to form a collar when in use. The connector assembly can comprise any suitable opposing connectors with one located proximate the intersection of the respective longitudinal edge and a top edge of the bag including but not limited to snaps, hook and loop material and buttons. It is to be appreciated that this feature is more likely to be used during lower outdoor temperatures, whereas during warmer temperatures, the additional freedom of movement offered by unsnapping the collar is likely to be more desirable to most users.

Two sets of opposing primary clips 210 are provided at spaced locations along the longitudinal edges. A lower left primary clip 210A is provided approximately midway along the longitudinal length of the bag on or closely proximate the left longitudinal edge 206. A corresponding opposing lower right primary clip 210B is provided directly laterally opposite the lower left primary clip on or closely proximate the right longitudinal edge 208 forming a lower primary clip set. An upper left primary clip 210C is provided approximately a quarter of the way down from the top end along the longitudinal length of the bag on or closely proximate the left longitudinal edge. A corresponding opposing upper right primary clip 210D is provided directly laterally opposite the upper left primary clip on or closely proximate the right longitudinal edge forming an upper primary clip set.

Figure 4:
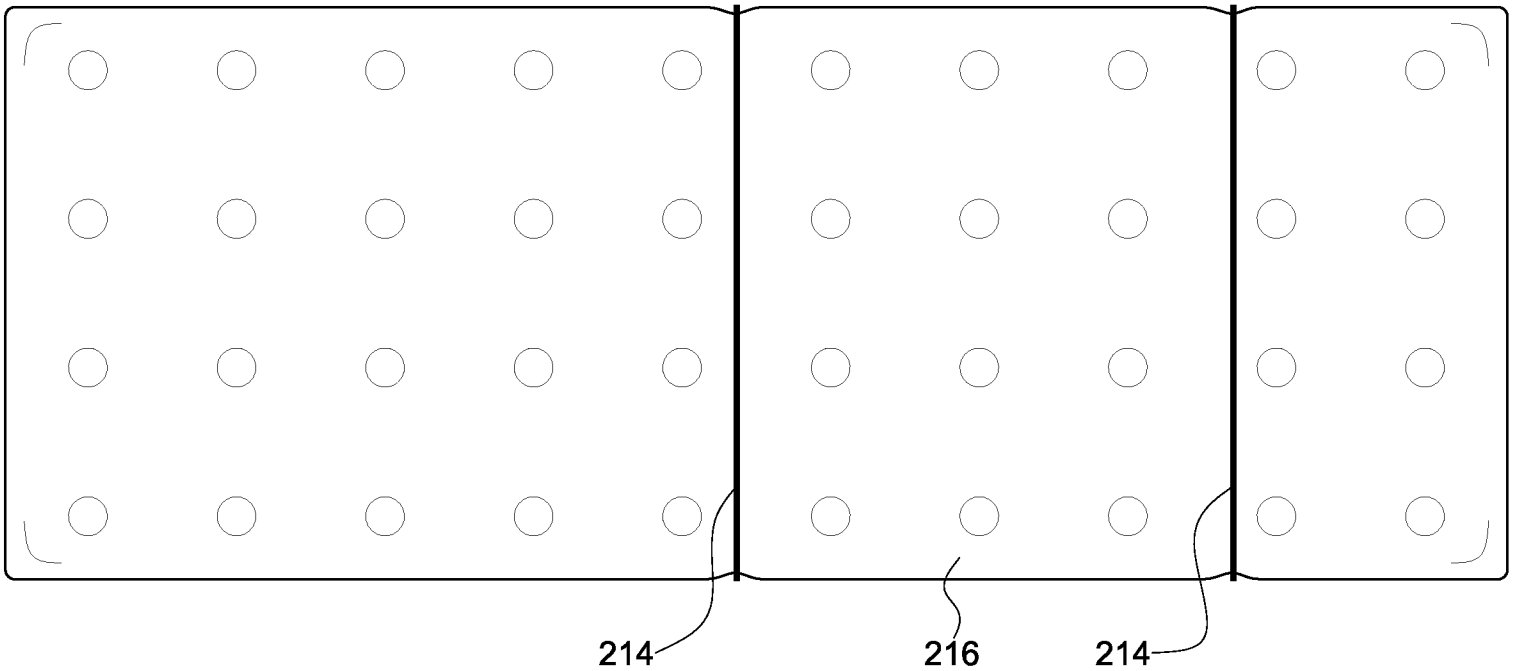
FIG. 4 is top view of an unrolled sleeping pad with pad-encircling cords secured there around according to embodiments of the present invention.

The clips 210A-D are adapted to be secured to corresponding cords 214 that are coupled to a sleeping pad 216 as is described in greater detail below with reference to FIGS. 7A&B. Further, FIG. 4 illustrates a pair of cord loops attached to a sleeping pad, which is also described in detail below.

Figure 5:
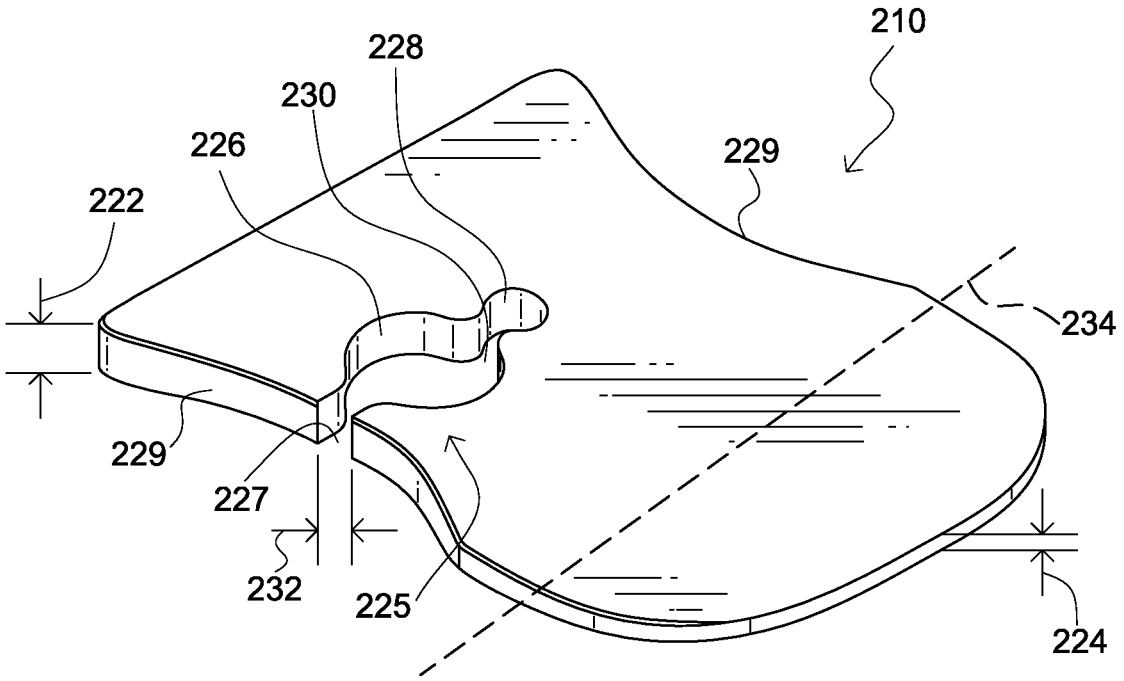
FIG. 5 is an isometric view of a primary cord clip according to embodiments of the present invention.

FIG. 5 is an illustration of a primary clip 210 as can be utilized in certain embodiments. The clip is typically comprised of a thermoplastic, such as nylon, that is injection molded, although other materials and methods of manufacture are contemplated. The clip is generally planer and plate-like but tapers in thickness from its distal end to its proximal end. Accordingly, the clip is thicker where it interfaces with a cord to more securely hold the cord in place but thinner where it is sewn into the edge seam of the bag as illustrated by the dashed line 234 to facilitate easier fabrication. In one variation, the clip is about 0.080" thick 222 at its thickest and about 0.030" thick at its thinnest 224. The laterally-extending edges 229 of the clip are scalloped in the illustrated clip to provide finger holds to be used when adjusting the clip; however, it is contemplated that the clip can be fabricated in any suitable shape.

One of the most significant features of the clip is the cord receiver 225, which acts to couple the clip and a corresponding cord 214. The cord receiver in the illustrated embodiment essentially comprises two differently-sized annular openings 226 & 228 that intersect to form a throat 230 there between. A large annular opening 226 is located proximate one of the laterally-extending edges 229 of the clip that generally extends in a lateral direction relative to a corresponding bag 200. The large annular opening is breached by an access throat 227 that extends to the clip edge 229. Of significant note, the width 232 of the throat is less than the diameter of the cord 214 with which the primary clip is configured for use, whereas the diameter of the large annular opening is significantly greater than the diameter of the associated cord.

Still referring to FIG. 5, the large annular opening 226 is in communication with the small annular opening 228 by way of the aforementioned intersection throat 230. Like the access throat, the width of the intersection throat is also typically less than the diameter of the associated cord 214. Further, however, the diameter of the smaller annular opening is typically the same as or slightly smaller than the unconstrained diameter of the associated cord. Accordingly, as explained below, the clip is essentially locked in place along the cord when it is placed in the smaller annular opening.

Referring back to FIG. 3, two sets of secondary clips 212A-D are also provided in the illustrated embodiment. A typical secondary clip is illustrated more closely in FIG. 6. The lower set of secondary clips 212A&B are positioned laterally in line with the lower set of primary clips 210A&B being spaced outwardly of the associated primary clips. The upper set of secondary clips 212C&D are positioned laterally in line with the upper set of primary clips 210C&D being spaced outwardly of the associated primary clips. Typically, each secondary clip is positioned laterally outwardly of the associated primary clip by about 3-6".

Figure 6:
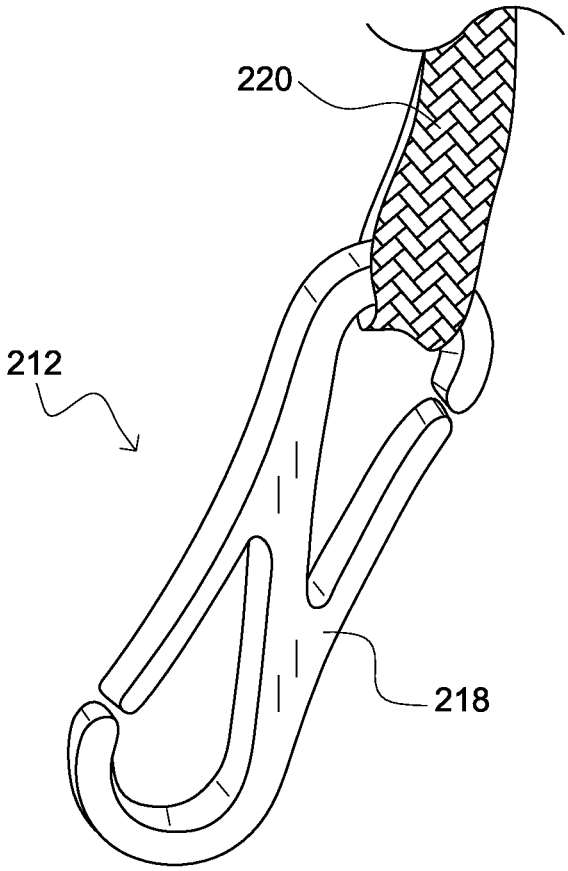
FIG. 6 is an isometric view of a secondary cord clip according to embodiments of the present invention.

As shown in FIG. 6, the secondary clip 212 is essentially comprised of two components: a loop of fabric webbing 220; and a plastic clip portion 218. As shown in FIG. 3, the loop of fabric webbing is typically sewn to the bag 200 at a baffle seam. The clip portion is secured to the loop at one end and includes a second end adapted to be loosely clipped to the corresponding cord 214, such that the clip can freely slide along the cord when attached thereto. The use of the secondary clip and some of its advantages are described in detail below.

Referring to FIG. 4, a typical sleeping pad 216 is illustrated with two loops of cord 214 secured laterally around the pad in positions that correspond with the locations of the primary and secondary clips on the bag 200 of FIG. 3. As can be appreciated, looped cords can be secured to most any camping sleeping pad at most any longitudinal position along the length of the pad. Each cord can be formed into a loop using any suitable means of joining the respective ends together, including tying the ends or through the use of a cord clasp. The loops are typically sized so that they are taut against the pad such that the cords are substantially retained in their longitudinal positions and they do not easily rotate around the pad.

While the use of cords 214, independent of any particular design and type of sleeping pad 216, permits a user to use embodiments of the quilt-style sleeping bag 200 with any number of sleeping pads, pads having the cords secured directly to them are also contemplated. For instance, one end of a cord may be sewn or otherwise fastened to one longitudinal edge of a pad with the other end being secured to the opposing longitudinal edge. Accordingly, the cord need only extend across the top face of the pad.

The use of the primary and secondary clips is best described with reference to FIGS. 7*a-b*, 8*a-c* & 9*a-b*.

In a typical configuration, the bag 200 is aligned with the pad 216 with the longitudinal locations of the clips 210 & 212 generally overlying the cords 214 of the pad. The bottom of the bag shown face up in FIG. 3 is placed downwardly against the pad as shown in FIG. 8A. The primary clips 210 are secured to the corresponding cords 214 in either a sliding configuration as shown in FIG. 7*a* or a secured configuration as shown in FIG. 7*b*.

Figure 7A:
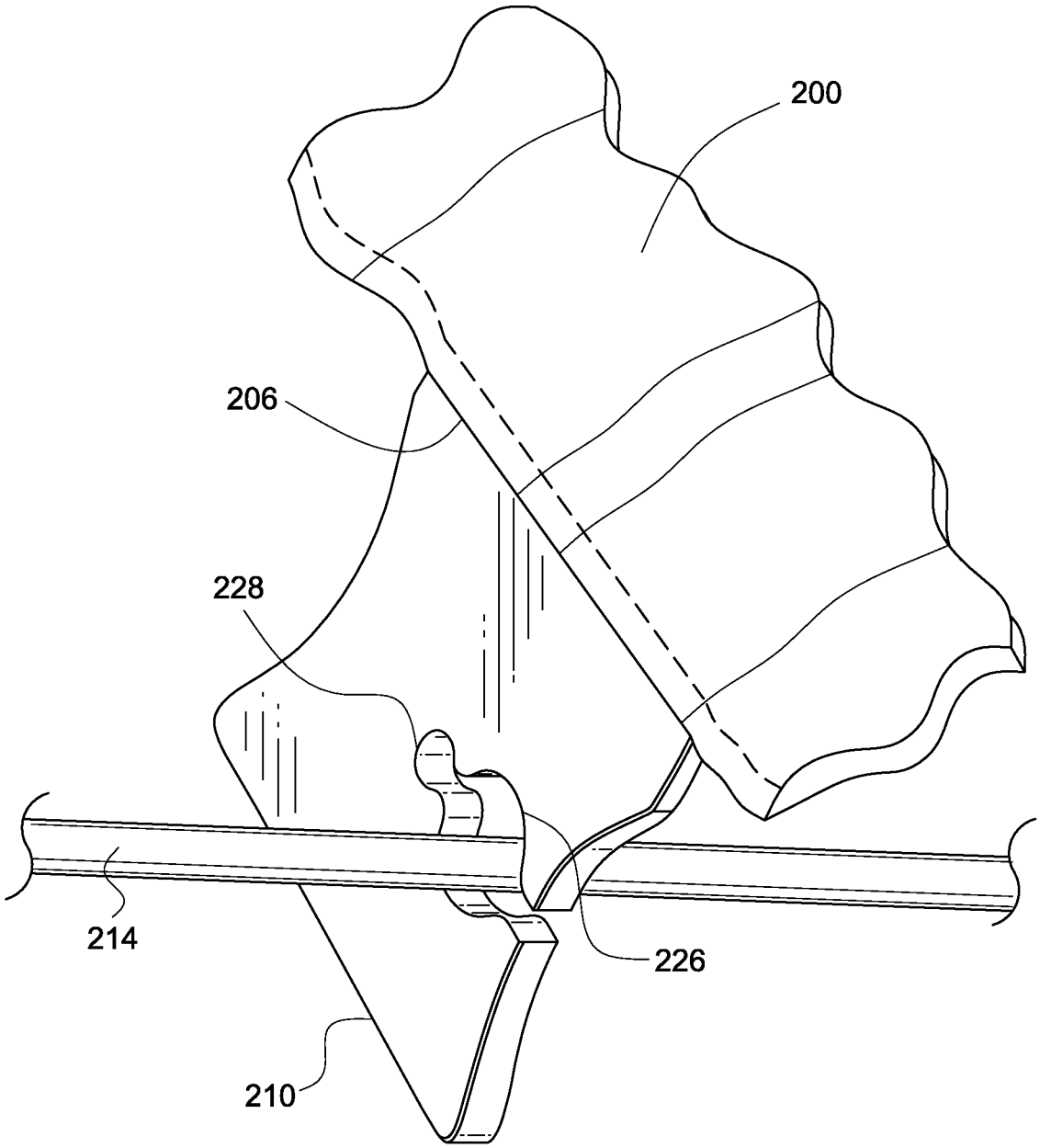
FIGS. 7*a* and 7*b* illustrate the primary cord clip of FIG. 5 with the clip secured on a cord in respective first and second positions according to embodiments of the present invention.
Figure 8A:
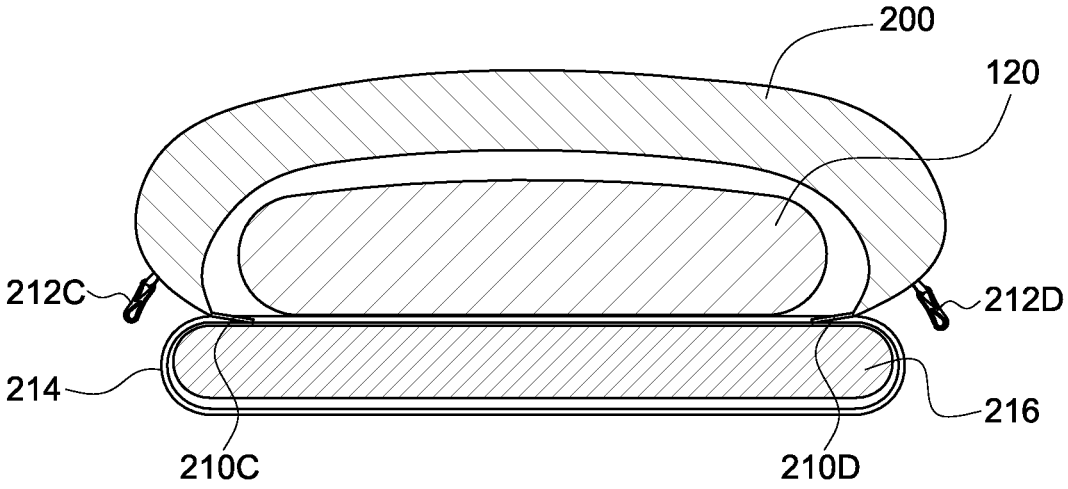
FIGS. 8*a-c* are stylized cross-sectional views of a user lying on a sleeping pad and covered by quilt-style sleeping bag incorporating primary and secondary clips in several configurations according to embodiments of the present invention.

In the sliding configuration of FIG. 7*a*, the cord 214 is snapped into the large annular opening 226 of the primary clip 210. Since the diameter of the large annular opening is significantly greater than the diameter of the cord, the clip is free to slide along the cord while remaining attached to the cord. This configuration permits the user 120 maximum freedom of movement as the clips will have the tendency to move toward the respective left and right edges of the pad 216 with user movement while maintaining contact between the left and right edges 206 & 208 of the bag and the top of the pad. This permits the user to easily slide the bag around him without significant effort or attention. The freedom of movement does potentially increase the interior volume within the bag/pad combination and, as such, the amount of air that must be heated by the user. Accordingly, this configuration is most suitable for warmer weather where maximum thermal efficiency is not needed or desired. This configuration is illustrated in FIG. 8A.

Figure 7B:
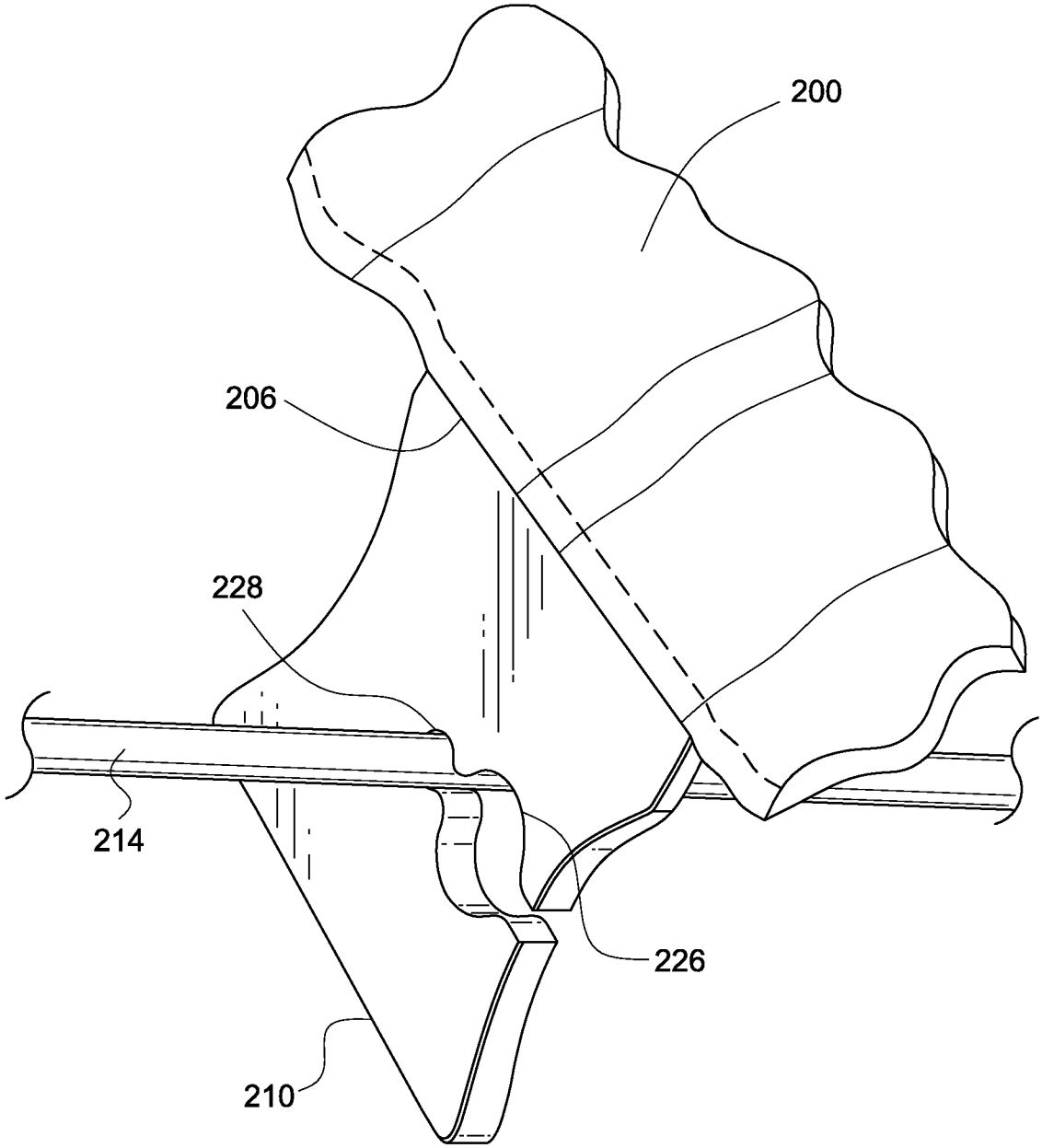
Figure 9A:
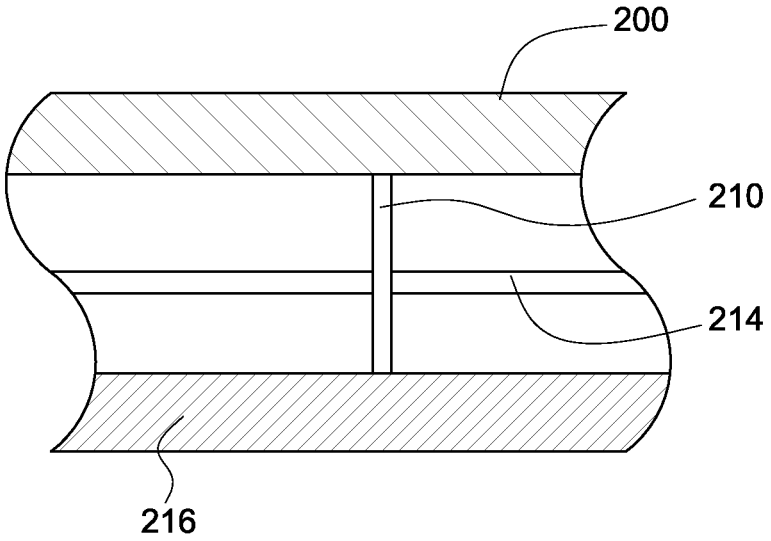
FIGS. 9*a-b* are partial side views illustrating the interaction between a primary clip and a corresponding cord when the combination is in the secured configuration according to embodiments of the present invention.
Figure 9B:
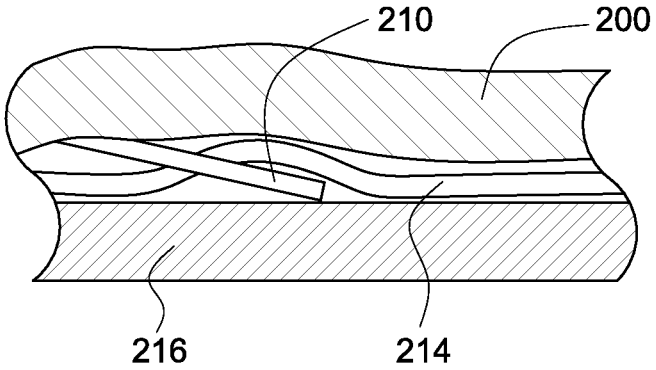

In the secured configuration of FIG. 7*b*, the cord 214 is snapped into the small annular opening 228, which inhibits the free movement of the clip 210 along the cord. The cord can, however, be moved along the cord with some effort by orientating the clip generally perpendicularly to the cord as shown in FIG. 9*a* and sliding the clip there along. When a desired position is achieved and the user releases his/her grasp on the clip, it naturally tends to lie somewhat flat against the pad 216 as shown in FIG. 9*b*. When in the flat position with the cord generally parallel to the clip, the edges of the annular opening bite into the cord and inhibit movement thereof, effectively locking the clip and bag in place.

Figure 8B:
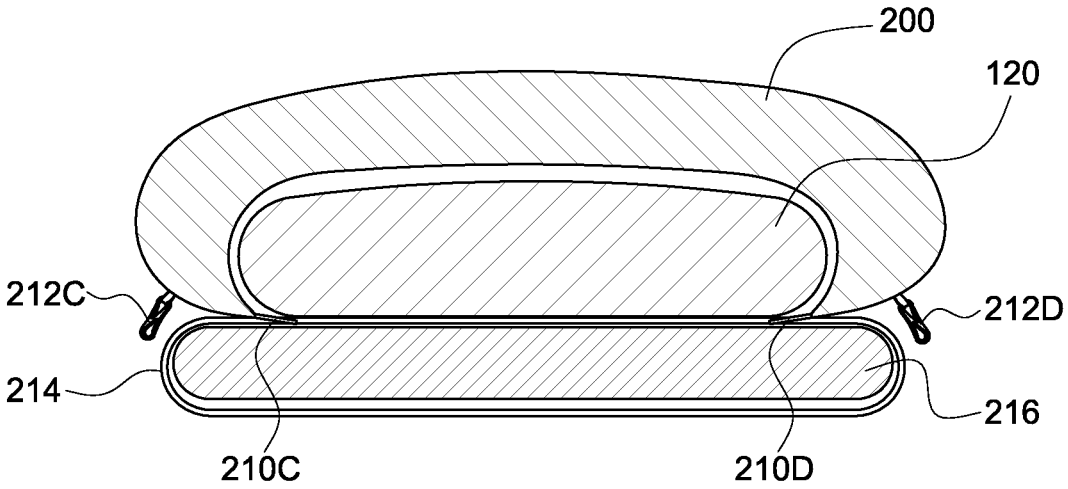

With the ability to lock the positions of the primary clips 210 along the associated cords 214, the user can pull the bag in close to the sides of his/her body 120 with the left and right longitudinal edges 206 & 208 being pulled underneath the body as is illustrated in FIG. 8*b*. This configuration minimizes interior volume and the associated air that a user has to heat, and as such, this configuration is desirable in colder weather wherein the user wants to maximize the bag's thermal efficiency.

Figure 8C:
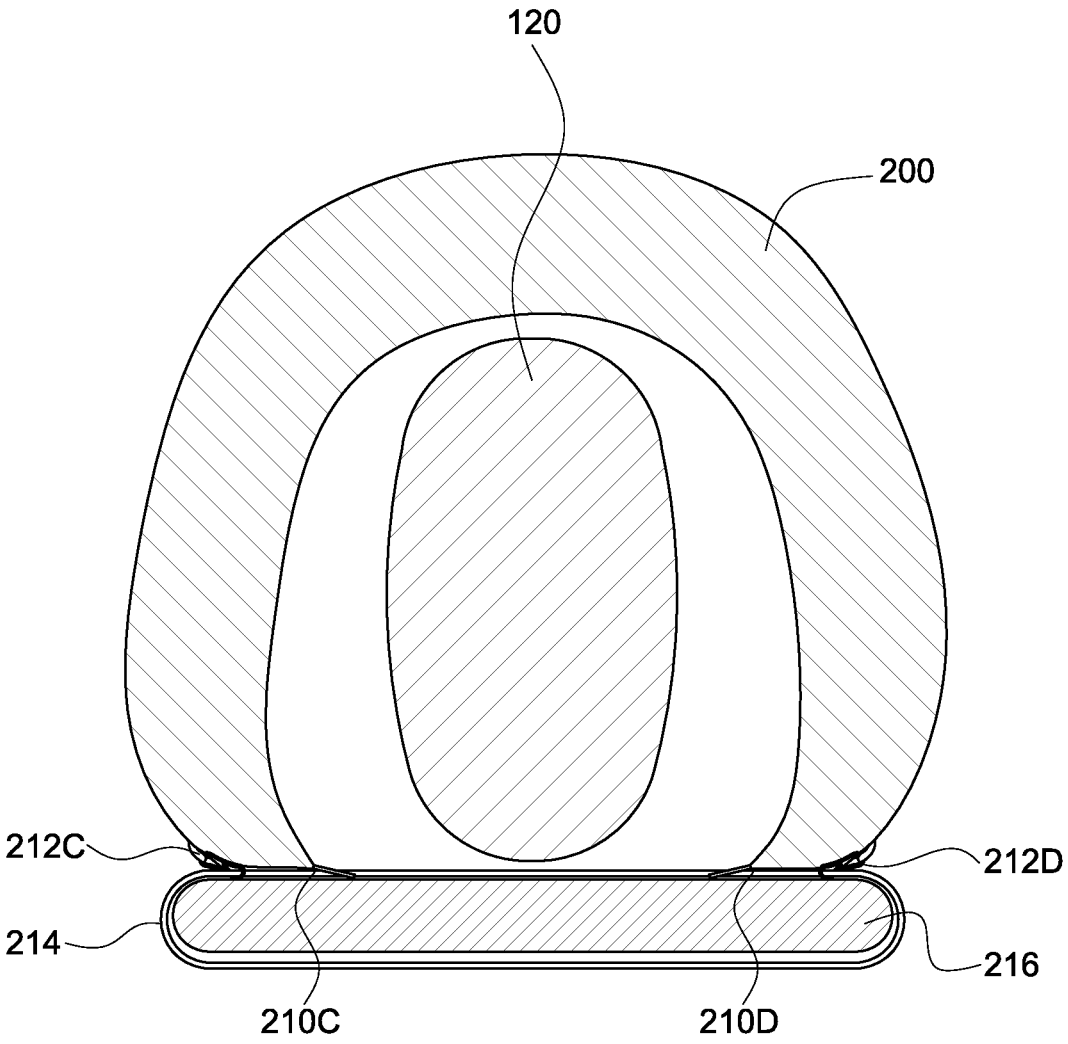

FIG. 8*c* illustrates the bag and pad combination with both the primary and secondary clips 210 & 212 being attached to the corresponding cord 214. As can be appreciated with reference to FIG. 6, the secondary clips are configured to freely slide along the cords when attached thereto in a manner not significantly different from the primary clips when in the free-sliding configuration. The secondary clips are typically used in conjunction with the primary clips to maximize the seal between the bag and the pad by creating a greater area of bag contact with the pad 216.

The added contact area helps prevent the longitudinal edges 206 & 208 from lifting off of the pad 216, permitting cold air drafts to enter the interior volume when a user 120 moves or changes position within the bag, such as changing to a side-sleeping position as shown in FIG. 8C. The secondary clips 212 can be utilized with the primary clips in either the free-sliding or secured configurations depending on the amount of thermal efficiency and the amount of flexibility to move and adjust positions desired by a user.

Method of Using Embodiments of the Quilt-Styled Sleeping Bag with a Sleeping Pad In use, a person, typically but not necessarily a backpacker, carries an embodiment of a quilt-style bag 200, such as the one illustrated in FIG. 3, in his/her backpack along with two or more looped cords 214 and a sleeping pad 216. Often, the backpacker will install the cords on the pad in the proper longitudinal positions prior to the rolling and packing of the sleeping pad, but alternatively, the cords can be secured on the pad just prior to use.

When the person has reached his/her destination for the evening, he/she unpacks the bag and pad, unrolls the pad and places it on a ground surface, such as the floor of a tent. Next, the quilt-style bag is placed generally over the pad with the bottom side of the bag as is illustrated in FIG. 3 being placed in contact with the top surface of the pad.

To secure the bag to the pad, each of the left primary clips 210 is attached to an associated looped cord. Further, each of the right primary clips 210 is also attached to the associated looped cord. In a sliding configuration wherein the clips are free to slide along the associated cords, the cords are placed into the first position of the clips as shown in FIG. 7A. In a locked configuration wherein the clips are effectively locked in position on the cords, the cords are placed in the second position as shown in FIG. 7B.

Typically, after the bag is secured to the top surface of the pad by way of the looped cords, the user slides into the bag with substantially all of his/her body contained within the interior volume of the bag with the possible exception of his/her head. In some circumstances, a user may lie down first on the pad and then secure the bag to the pad by way of the clips and cords. In yet other circumstances, a user can secure one set of the left and right clips, place himself on the pad and then secure the other set of clips. It is further appreciated that the user might place the cord in the first position relative to all clips, enter the bag and then slide the clips along the cords to a desired position wherein he/she locks the clips by moving the cords into the clips' second positions.

In some circumstances, such as when it is particularly cold, a user can attach the secondary clips to the looped cords as is best shown in FIG. 8C. In this configuration, a greater amount of the bag's bottom side proximate the respective left and right longitudinal edges 206 & 208 is held against the top surface of the pad, better protecting the user from drafts of cold air entering the interior volume of the bag and pad combination.

Variations and Other Embodiments

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, the cords can be replaced with straps comprised of flat webbing. To accommodate such a change, primary and secondary clips of different configurations can be specified to interface with the webbing. In other variations, the clips can comprise hook and loop material, buckles, snaps or any other means that permits the attachment of the left and right longitudinal edges of a Quilt-style bag to the top of an associated pad.

While the embodiment described as illustrated herein includes both primary and secondary clips, as well as a strap and buckle assembly and a collar snap assembly, it is to be appreciated that other embodiment and variations can be produced with any combination of these features. For instance, a bag having only primary clips and no secondary clips is contemplated.

I claim:

1. A sleeping bag system comprising:

a sleeping pad;

two or more cord loops, each cord loop encircling the sleeping pad;

an insulated blanket, the insulated blanket including, a left longitudinal edge, a right longitudinal edge, a plurality of left primary clips attached to the blanket proximate the left longitudinal edge, each of the left primary clips removably attached to at least one of the cord loops of the two or more cord loops, and a plurality of right primary clips attached to the blanket proximate the right longitudinal edge, each of the right primary clips removably attached to at least one of the cord loops of the two or more cord loops.

2. The sleeping bag system of claim 1, wherein the plurality of left primary clips are removably attached to the two or more cord loops, and the plurality of right primary clips are removably attached to the two or more cord loops.

3. The sleeping bag system of claim 1, wherein the insulated blanket includes a bottom portion, the bottom portion being configured as a foot box with the left and right longitudinal edges diverging from each other at a top end of the foot box.

4. The sleeping bag system of claim 3, further including a strap and buckle assembly spanning generally laterally from the left longitudinal edge to the right longitudinal edge about 4-12 inches longitudinally from the top end of the foot box, the strap and buckle assembly having an adjustable length.

5. The sleeping bag system of claim 1, wherein the insulated blanket includes a top end collar with components of a connector assembly being located proximate (i) an intersection of the left longitudinal edge and the top end collar and (ii) an intersection of the right longitudinal edge and the top end collar, the connector assembly adapted to join the respective left and right longitudinal edges together at the top end collar.

6. The sleeping bag of claim 5 wherein the connector assembly comprises a snap assembly.

7. The sleeping bag of claim 1, further including:

a plurality of left secondary clips attached to the blanket spaced about 3-6" from the left longitudinal edge, each of the left secondary clips being (a) adapted for removable attachment to at least one of the cord loops of the two or more cord loops, and (b) aligned with an associated left primary clip of the plurality of left primary clips along a generally laterally extending axis; and a plurality of right secondary clips attached to the blanket spaced about 3-6" from the right longitudinal edge, each of the right secondary clips being (a) adapted for removable attachment to at least one of the cord loops of the two or more cord loops, and (b) aligned with an associated right primary clip of the plurality of right primary clips along a generally laterally extending axis.

8. The sleeping bag of claim 1, wherein each of the primary clips includes first and second cord holding positions, the first cord holding position permitting each of the primary clips, when attached to an associated cord loop of the two or more cord loops, to slide freely along the associated cord loop in a sliding configuration and the second cord-holding position substantially locking each of the primary clips in place on the associated cord loop in a locked configuration.

9. The sleeping bag of claim 8, wherein the first cord holding position in each primary clip comprises a first opening having an effective diameter significantly greater than an unconstrained diameter of the associated cord loop, and wherein the second cord holding position in each primary clip comprises a second opening having an effective diameter equal to or less than the unconstrained diameter of the associated cord loop.

10. The sleeping bag of claim 9, wherein the first and second openings are operatively coupled by way of a throat.

11. The sleeping bag of claim 10, wherein each primary clip is generally planar and plate-like, each primary clip having a first thickness proximate a location wherein each primary clip interfaces with and is secured to the sleeping bag by way of stitching and a second thickness proximate and surrounding the first and second openings, the first thickness being less than the second thickness.

12. The sleeping bag system of claim 1, wherein the sleeping pad comprises a closed cell foam.

13. The sleeping bag system of claim 12, wherein the insulated blanket includes left and right secondary clips, the left and right secondary clips being attached to the blanket spaced about 3-6" from the corresponding longitudinal edge with each of the secondary clips being (a) adapted for removable attachment to at least one of the cord loops of the two or more cord loops, and (b) aligned with an associated primary clip of the plurality of left and right primary clips along a generally laterally extending axis.

14. The sleeping bag system of claim 12, wherein each primary clip includes first and second cord-holding position, the first cord-holding position permitting each of the primary clips, when attached to an associated cord loop of the two or more cord loops, to slide freely along the associated cord loop in a sliding configuration, and the second cord-holding position substantially locking each of the primary clips in place on the associated cord loop in a locked configuration.

15. A sleeping bag system comprising:

a sleeping pad;

two or more cord loops, each cord loop secured circumferentially around the sleeping pad;

an insulated blanket, the insulated blanket including, (a) a left longitudinal edge, (b) a right longitudinal edge, (c) wherein the insulated blanket includes a bottom portion, the bottom portion being configured as a foot box with the left and right longitudinal edges diverging from each other at a top end of the foot box, (d) a plurality of left primary clips attached to the blanket proximate the left longitudinal edge, each of the left primary clips (i) removably attached to at least one of the cord loops of the two or more cord loops and (ii) including first and second cord-holding positions, the first cord-holding position permitting the plurality of left primary clips, when attached to an associated cord loop of the two or more cord loops, to slide freely along the associated cord loop in a sliding configuration, and the second cord-holding position substantially locking the plurality of left primary clips in place on the associated cord loop in a locked configuration, (e) a plurality of right primary clips attached to the blanket proximate the right longitudinal edge, each of the right primary clips (i) removably attached to at least one of the cord loops of the two or more cord loops and (ii) including first and second cord-holding positions, the first cord-holding position permitting the plurality of right primary clips, when attached to an associated cord loop of the two or more cord loops, to slide freely along the associated cord loop in a sliding configuration, and the second cord-holding position substantially locking the plurality of right primary clips in place on the associated cord loop in a locked configuration, (f) a plurality of left secondary clips attached to the blanket spaced about 3-6" from the left longitudinal edge, each of the left secondary clips being (a) adapted for removable attachment to at least one of the cord loops of the two or more cord loops, and (b) aligned with an associated left primary clip of the plurality of left primary clips along a generally laterally extending axis, and (g) a plurality of right secondary clips attached to the blanket spaced about 3-6" from the right longitudinal edge, each of the right secondary clips being (a) adapted for removable attachment to at least one of the cord loops of the two or more cord loops, and (b) aligned with an associated right primary clip of the plurality of right primary clips along a generally laterally extending axis.

16. A sleeping bag system comprising:

two or more cord loops, each cord loop adapted to be secured circumferentially around a sleeping pad;

an insulated blanket, the insulated blanket including, a left longitudinal edge, a right longitudinal edge, a plurality of left primary clips attached to the blanket proximate the left longitudinal edge, each of the left primary clips being adapted for removable attachment to at least one of the cord loops of the two or more cord loops, and a plurality of right primary clips attached to the blanket proximate the right longitudinal edge, each of the right primary clips being adapted for removable attachment to at least one of the cord loops of the two or more cord loops;

wherein each primary clip is generally planar and plate-like, each primary clip including, a front edge having a first thickness, a back edge having a second thickness, the first thickness tapering down to the second thickness, the second thickness proximate a location wherein each primary clip interfaces with and is secured to the sleeping bag by way of stitching, a right edge being scalloped, and a left edge being scalloped.

17. The sleeping bag system of claim 16, wherein the insulated blanket includes a bottom portion, the bottom portion being configured as a foot box with the left and right longitudinal edges diverging from each other at a top end of the foot box.

18. The sleeping bag system of claim 16, wherein each of the primary clips includes first and second cord holding positions, the first cord holding position permitting each of the primary clips, when attached to an associated cord loop of the two or more cord loops, to slide freely along the associated cord loop in a sliding configuration and the second cord-holding position substantially locking each of the primary clips in place on the associated cord loop in a locked configuration.

19. The sleeping bag system of claim 18, wherein the first cord holding position in each primary clip comprises a first opening having an effective diameter significantly greater than an unconstrained diameter of the associated cord loop, and wherein the second cord holding position in each primary clip comprises a second opening having an effective diameter equal to or less than the unconstrained diameter of the associated cord loop.

20. The sleeping bag system of claim 19, wherein the first and second openings are operatively coupled by way of a throat.

* * * * *